US012398552B2

(12) United States Patent
Carlson et al.

(10) Patent No.: US 12,398,552 B2
(45) Date of Patent: Aug. 26, 2025

(54) TWO-PART CLAMPING BUILDING SUPPORT HANGER

(71) Applicant: OMG Building Products LLC, Agawam, MA (US)

(72) Inventors: Logan Carlson, Wilbraham, MA (US); Jonathan W. Dezielle, Agawam, MA (US); Mitchell T. Kraucunas, Enfield, CT (US); Anthony DiSanto, Holyoke, MA (US); Timothy F. Gillis, Florence, MA (US)

(73) Assignee: OMG Building Products LLC, Agawam, MA (US)

( * ) Notice: Subject to any disclaimer, the term of this patent is extended or adjusted under 35 U.S.C. 154(b) by 282 days.

(21) Appl. No.: 17/917,399

(22) PCT Filed: Apr. 14, 2021

(86) PCT No.: PCT/US2021/027251

§ 371 (c)(1),
(2) Date: Oct. 6, 2022

(87) PCT Pub. No.: WO2021/211693

PCT Pub. Date: Oct. 21, 2021

(65) Prior Publication Data

US 2023/0151604 A1 May 18, 2023

Related U.S. Application Data

(60) Provisional application No. 63/009,494, filed on Apr. 14, 2020.

(51) Int. Cl.
*E04B 1/26* (2006.01)

(52) U.S. Cl.
CPC ..... *E04B 1/2612* (2013.01)

(58) Field of Classification Search
CPC ..... E04B 1/2612
See application file for complete search history.

(56) References Cited

U.S. PATENT DOCUMENTS 625,427 A 5/1899 Stewart
796,433 A 8/1905 Kahn
(Continued)

FOREIGN PATENT DOCUMENTS

BE 1017165 3/2008
DE 9400091 2/1994
(Continued)

OTHER PUBLICATIONS

Search Report/Written Opinion.
How to How to Choose the Right Joist Hanger; BulldersMetalwork.com; Mar. 23, 2020.

*Primary Examiner* — Patrick J Maestri
(74) *Attorney, Agent, or Firm* — Alix, Yale & Ristas, LLP

(57) ABSTRACT

A hanger for attaching an elongate beam to a building support includes a first member attachable to a second member. The first member includes a side and a web section with locking teeth. The second member includes a slot with at least one locking tooth. The slot of the second member may be formed in a second web section. The first member and second member are lockable to each other at a plurality of different lateral positions to accommodate elongate beams having a variety of thicknesses.

23 Claims, 13 Drawing Sheets

(56) References Cited

U.S. PATENT DOCUMENTS

| | | | | |
|---|---|---|---|---|
| 1,976,595 | A | 10/1934 | Asleson | |
| 4,003,179 | A | 1/1977 | Gilb | |
| 4,260,123 | A | 4/1981 | Ismert | |
| 4,564,163 | A | 1/1986 | Barnett | |
| 5,111,632 | A * | 5/1992 | Turner | E04B 1/2612 52/703 |
| 5,423,501 | A | 6/1995 | Yu | |
| 5,603,580 | A | 2/1997 | Leek et al. | |
| 5,611,189 | A | 3/1997 | Fleck | |
| 5,836,131 | A | 11/1998 | Viola et al. | |
| 5,910,085 | A | 6/1999 | Pruett | |
| 6,631,587 | B2 | 10/2003 | Lynch | |
| 6,651,937 | B1 | 11/2003 | Wilson | |
| 8,978,339 | B2 | 3/2015 | Doupe et al. | |
| 9,115,506 | B2 | 8/2015 | Hill | |
| 9,181,713 | B1 * | 11/2015 | Farahmandpour | E04F 13/0864 |
| 10,227,772 | B1 | 3/2019 | Hill | |
| 2006/0123723 | A1 | 6/2006 | Weir | |
| 2007/0193194 | A1 | 8/2007 | Smith | |
| 2008/0202060 | A1 | 8/2008 | Pilpel | |
| 2008/0237421 | A1 | 10/2008 | Szpotowski | |
| 2008/0283702 | A1 | 11/2008 | Ikerd | |
| 2009/0113839 | A1 | 5/2009 | Carr | |
| 2016/0369496 | A1 | 12/2016 | Farahmandpour | |

FOREIGN PATENT DOCUMENTS

| | | |
|---|---|---|
| GB | 2156398 | 10/1985 |
| GB | 2176222 | 12/1986 |

* cited by examiner

TWO-PART CLAMPING BUILDING SUPPORT HANGER

CROSS-REFERENCE TO RELATED APPLICATION

This application claims priority to U.S. Provisional Patent Application No. 63/009,494 for "Two-Part Clamp Joist Hanger", filed Apr. 14, 2020, the entire content of which is incorporated herein by reference.

BACKGROUND

This disclosure relates generally to the field of building construction connectors, more particularly to a hanger for supporting and attaching an elongate building support member relative to a building support member, and more particularly a two-part laterally clamping building member support hanger optionally with preset fasteners, which may be utilized for attaching joists to a ledger.

In construction and building fields, brackets and hangers are common for assisting in the connection of one building member to another, such as an elongate joist to a rear support member, such as a ledger. Hangers are often formed of metal, such as steel and include numerous sides and surfaces used for attaching to a support member and joist, and holding and supporting the joist.

One common type of joist is a deck or floor joist used as a substructure to support an overlying deck or floor structure. Deck joists can attach to an end support member, usually on a side of a building, and extend substantially perpendicular therefrom at a height substantially parallel to the other joists. A joist hanger is used as an intermediate member to attach the joists to the support member. Joist hangers are usually formed of a single piece of steel with opposite sides and a bottom web for holding and supporting a joist from underneath, and rear and/or top flange elements for attaching to a support member. Typically, a joist is installed via first attaching a joist hanger to a ledger at a specific height, then placing the end of a joist within the joist hanger supported by the hanger web portion. Once in place, the joist can be secured by driving fasteners through portions of the hanger straight into the joist and/or obliquely so as to pass through the joist and into the ledger for enhanced strength.

A common type of fastener attachment technique is referred to in the building industry as "toenailing" or a "toenail" connection, whereby two fasteners are driven obliquely through opposite sides of the joist and into the support member. This technique can be employed with or without a joist hanger to enhance the strength of the connection.

One common difficulty associated with installing joists is ensuring that all fasteners are driven at the preferred positions and even angles and positions as required by code. Additionally, there are no known joist hangers that can be attached to a joist prior to the ledger. Additionally, there are no known joist hangers that can be used with joists of varying sizes. Typically, a specifically sized joist hanger is required for each size joist. Thus, it would be useful to provide a joist hanger with capabilities to improve upon these common issues.

SUMMARY

In one embodiment, a clamping hanger for attaching an elongate building member to a building support member comprises a first member and a second member. The first member defines a first side and a first lateral web section having at least one first locking tooth. The second member defines a second side and a channel with a second locking tooth cooperative with the at least one first locking tooth. The first member and second member are lockingly attachable to one another via cooperation of the at least one first locking tooth and the second locking tooth to trap the elongate building member between the first side and second side in a clamped arrangement with the first web section in abutment with an edge of the elongate building member.

In another embodiment, a clamping hanger for attaching an elongate building member to a building support member comprises a first member and second member. The first member comprises a flat first side member and a laterally extending first web member, and the second member comprises a flat second side member and a laterally extending second web member. The first web member and second web member include cooperative ratchet teeth to lock to one another and thereby attach the first member to the second member to trap a joist between the first side member and second side member in a clamped arrangement.

In yet another embodiment, a method of attaching an elongate building member to a building support includes the initial steps of providing an elongate building member and providing a two-part hanger. The two-part hanger comprises a first member with a first side panel and a first web section that includes a first locking member. The second member comprises a second side panel and second web section that includes a second locking member that is cooperative with the first locking member. The first member is attached to the second member with an end of the elongate building member between the first side panel and second side panel via connection of the first locking member to the second locking member with the elongate building member clamped between the first side panel and second side pane. The hanger and elongate beam are then attached to a ledger.

In one embodiment, the first member and second member may be formed of a polymer or composite material.

In one embodiment, the first member and second member are contoured to clampingly trap an I-beam.

In one embodiment, a ratchet channel is formed in a second web member of the second member.

In one embodiment, the channel includes a plurality of spaced apart locking teeth.

In one embodiment, the first member and second member are attachable to one another at a variety of different lateral positions.

In one embodiment, the first member and second member each includes a rear flange. The rear flanges may be perpendicular to the first side and the second side and may also define openings for fasteners.

In one embodiment, the first member and second member define a plurality of fastener guide openings through which a fastener can be driven.

The fastener guide openings may be formed by cylindrical projections.

In one embodiment, fastener guide openings extend obliquely through each side member of the first and second member.

DETAILED DESCRIPTION

Figure 1:
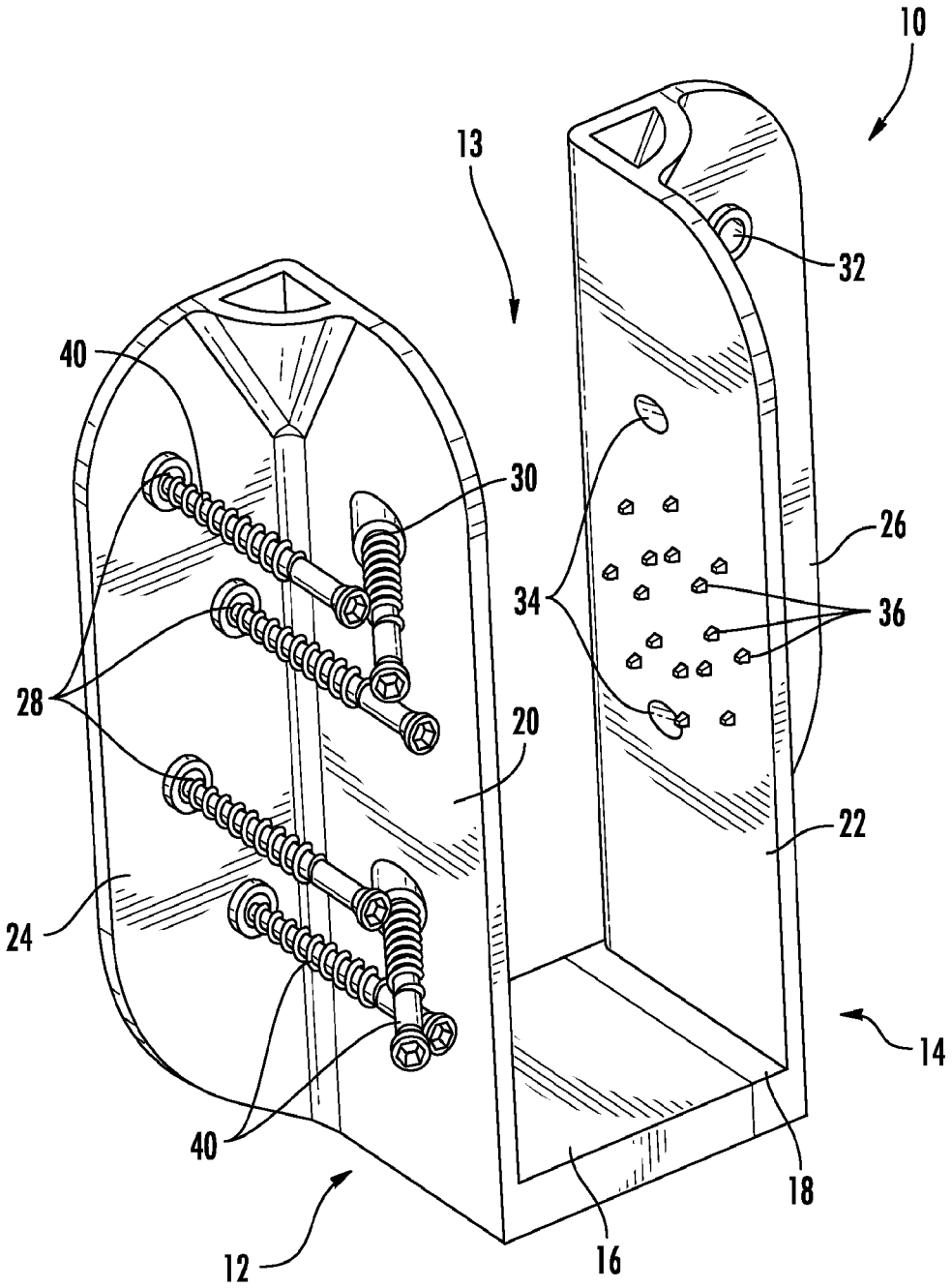
FIG. 1 shows an embodiment of a two-part joist hanger with preset fasteners.

Among the benefits and improvements disclosed herein, other objects and advantages of the disclosed embodiments will become apparent from the following wherein like numerals represent like parts throughout the several figures. Detailed embodiments of clamping hanger for use in securing building support members are disclosed; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrase "in some embodiments" as used herein does not necessarily refer to the same embodiment(s), though it may. The phrases "in another embodiment" and "in some other embodiments" as used herein do not necessarily refer to a different embodiment, although it may. Thus, as described below, various embodiments may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described unless the context clearly dictates otherwise. In addition, throughout the specification, the meaning of "a," "an," and "the" include plural references. The meaning of "in" includes "in" and "on".

Further, the terms "substantial," "substantially," "similar," "similarly," "analogous," "analogously," "approximate," "approximately," and any combination thereof mean that differences between compared features or characteristics is less than 25% of the respective values/magnitudes in which the compared features or characteristics are measured and/or defined.

Additionally, the embodiments described herein are done so with primary reference to a preferred embodiment that is a joist hanger for attaching a joist beam to a rear ledger. However, it is understood that the embodiments are not limited as such, and the inventive concepts embodied in the disclosed embodiments apply to a wide variety of hangers or brackets for use in attaching elongate building support members or beams to another support member. Herein, the term "joist" is synonymous with and shall encompass a beam or elongate building member. Likewise, the term "ledger" is synonymous with and shall encompass any building support member or structure to which a beam may be attached.

With reference to the drawings wherein like numerals represent like parts throughout the figures, a laterally clamping joist hanger 10 is shown and described. The hanger 10 includes two cooperative half portions (referred to herein as a left member 12 and right member 14) that attach via a locking ratchet engagement. When the left member and right member are attached, they combine to form the joist hanger 10 with opposite left and right side panels, 20 and 22, separated from each other by a laterally extending web 17 and defining a cavity 13 for maintaining an end of a beam (i.e., joist J). As will be discussed in detail below, the web is formed by an outer web member 16 in one portion (left) and an inner web member 18 in the opposite portion (right) that engage cooperatively with one another in a ratchet locking attachment. In the depicted embodiments, the outer member 16 is part of the left member 12 and the inner member 18 is part of the right member 14, however, embodiments exist wherein this relative configuration is reversed.

Each of the half portions includes a rear flange 24/26 extending at an approximately right angle from the left and right side panels, 20/22, respectively. The depicted embodiments employ outer rear flanges 24/26, however, embodiments exist with rear flanges that extend at right angles from the sides 20/22 to the inside of the joist hanger 10. The inner surfaces of the left and right sides 20/22 can be provided with a plurality of prongs or teeth 36 for puncturing the surface of a wooden joist and assisting a robust locking attachment of the hanger 10. As shown in the Figures, the rear flanges 24/26 include one or more tubular support surfaces defining rear fastener openings 28/32, which extend substantially perpendicularly through the flange. Each of the side members 20/22 includes one or more tubular support surfaces defining side fastener openings 30/34. In contrast to the rear openings 28/32, the side fastener openings 30/34 preferably extend obliquely through the respective side member 20/22. The oblique relationship is specifically configured to assist in creating a toenail connection between the hanger 10, joist J and ledger L. With reference to FIG. 1, each of the respective tubular support surfaces that form the rear openings 28/32 and side openings 30/34 are configured to support a fastener 40 that may come preset within the respective opening. Providing a hanger with at least some preset fasteners aligned within the openings in this manner improves installation time and can improve preciseness of the angle at which the fasteners are driven.

Figure 9:
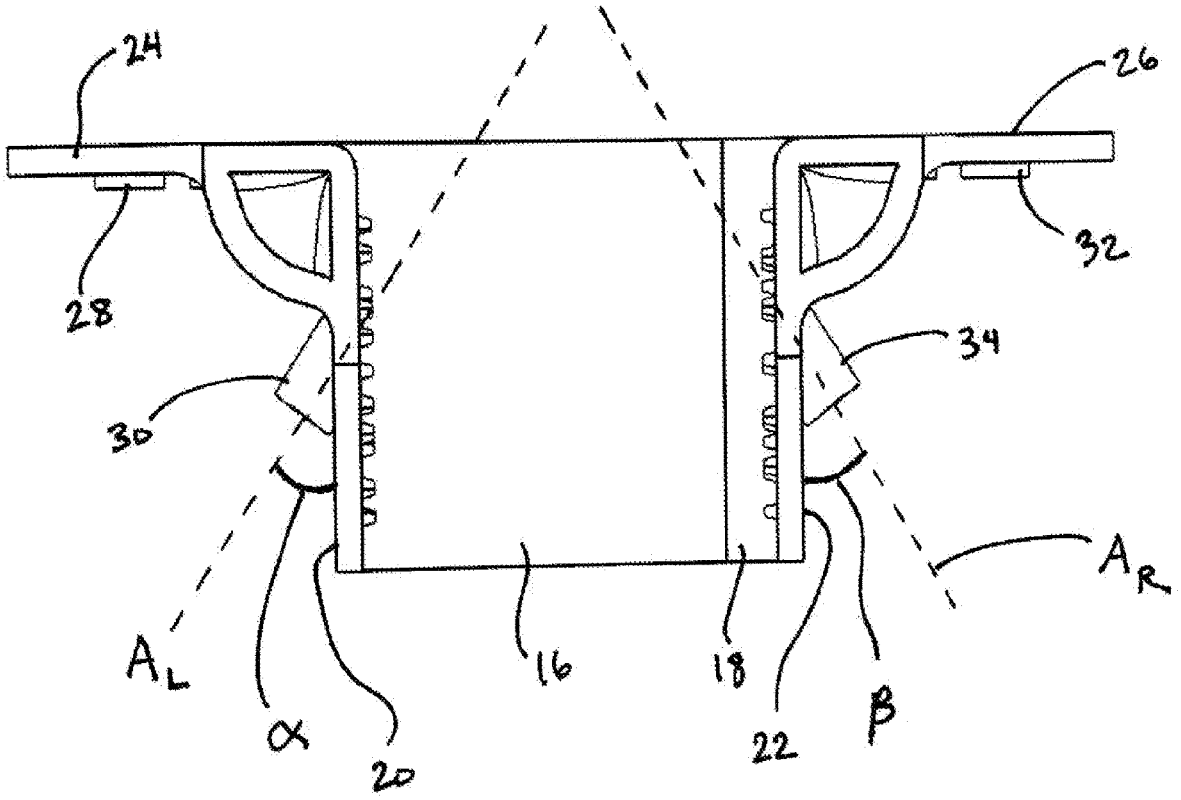
FIG. 9 is a top elevation view of the disclosed joist hanger.
Figure 10:
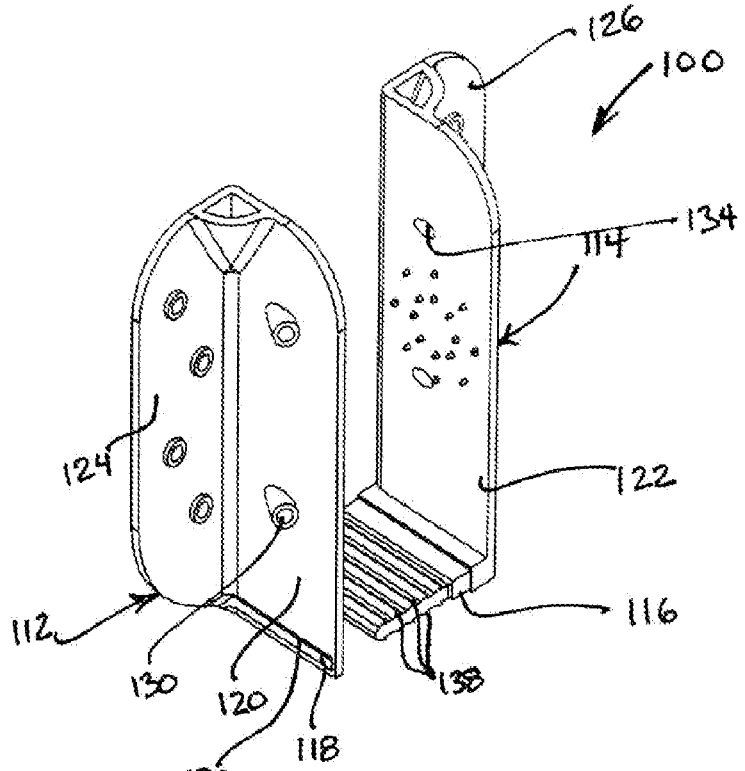
FIG. 10 shows a perspective view of another embodiment of the disclosed joist hanger with first and second members unattached.
Figure 11:
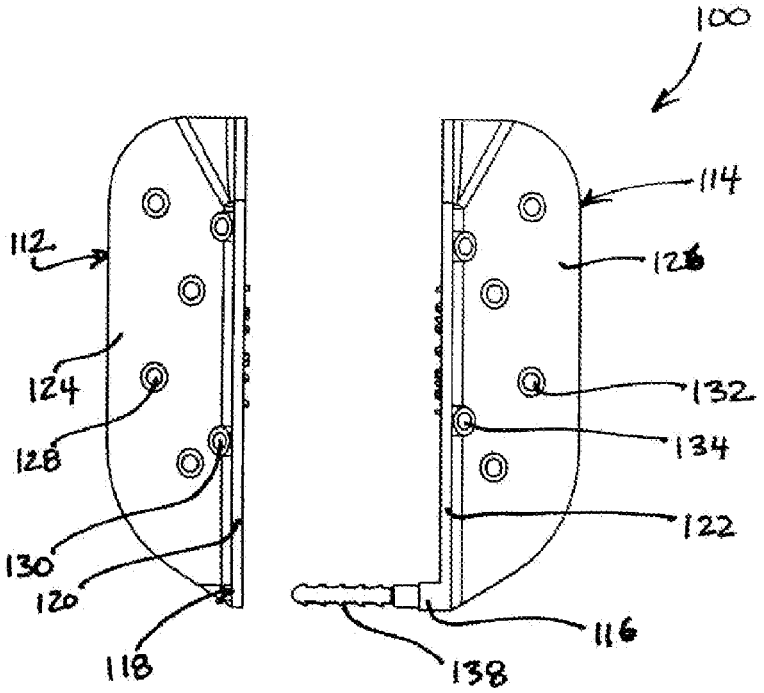
FIG. 11 is a front elevation view of the hanger of FIG. 10.
Figure 12:
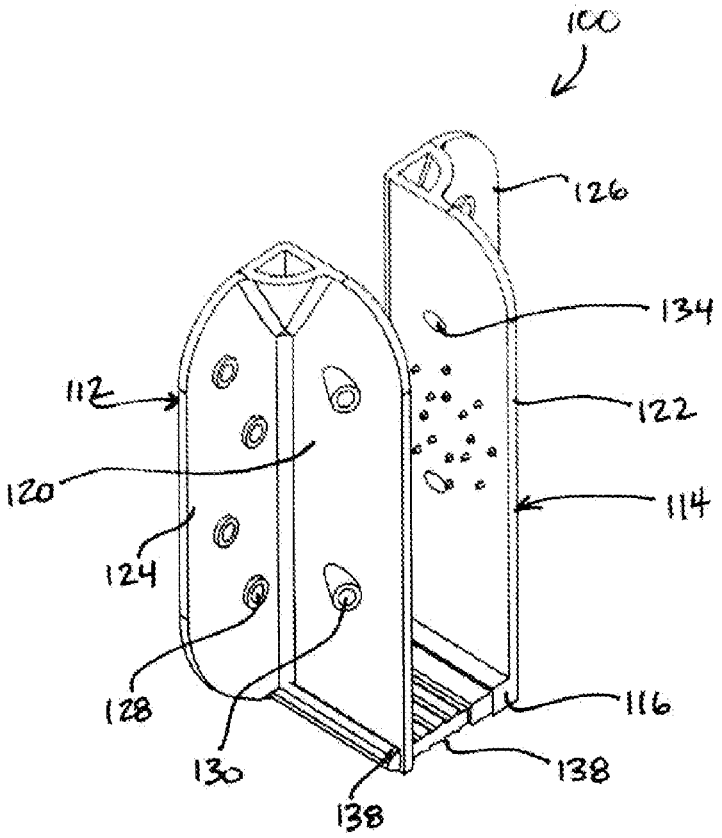
FIG. 12 is a perspective view of the hanger of FIG. 10 with the first and second members attached to each other.
Figure 13:
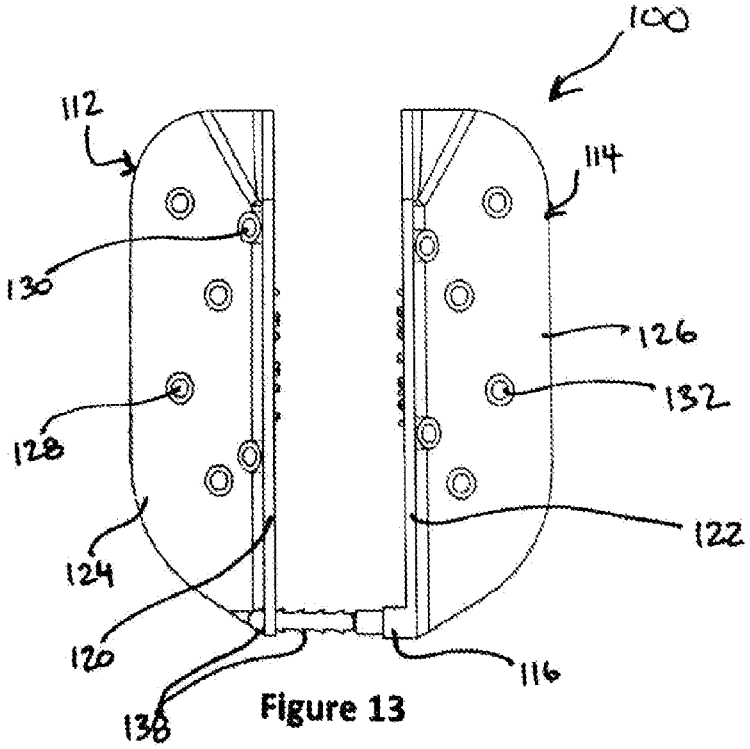
FIG. 13 is a front elevation view of the hanger of FIG. 12.
Figure 14:
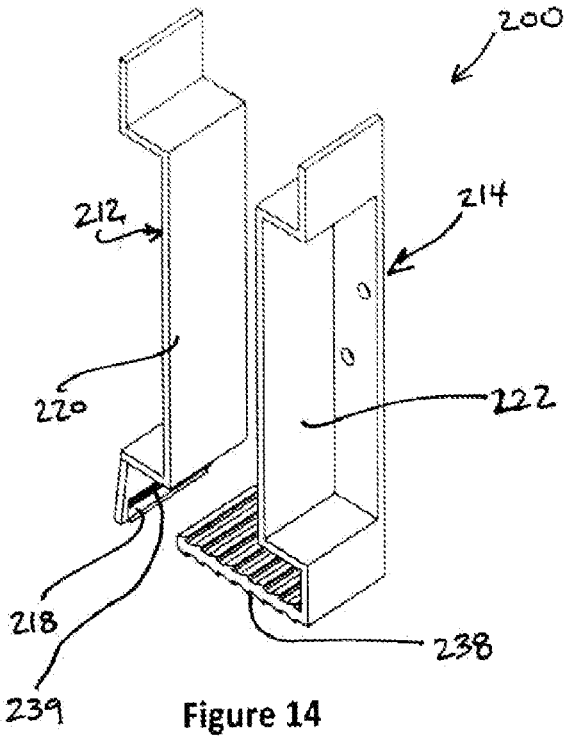
FIG. 14 is a perspective view of yet another embodiment of the disclosed hanger configured for clamping engagement with an I-beam.
Figure 15:
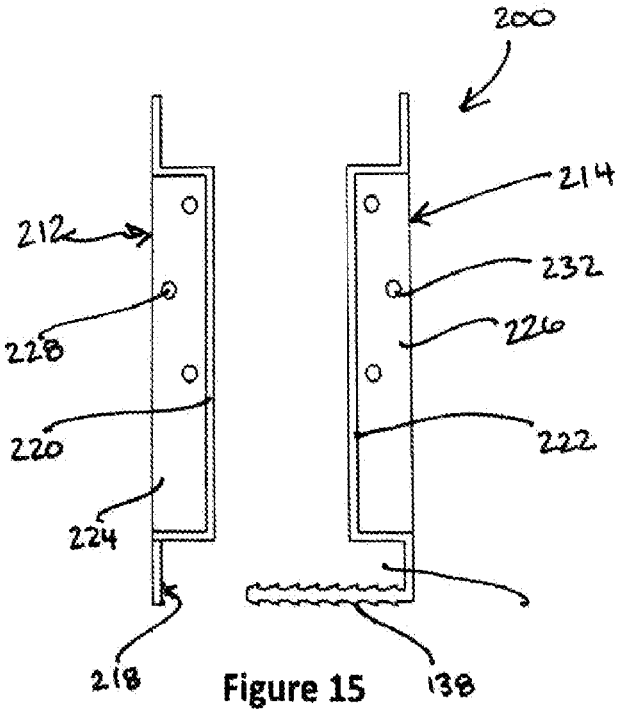
FIG. 15 is a front elevation view of the hanger of FIG. 14.
Figure 16:
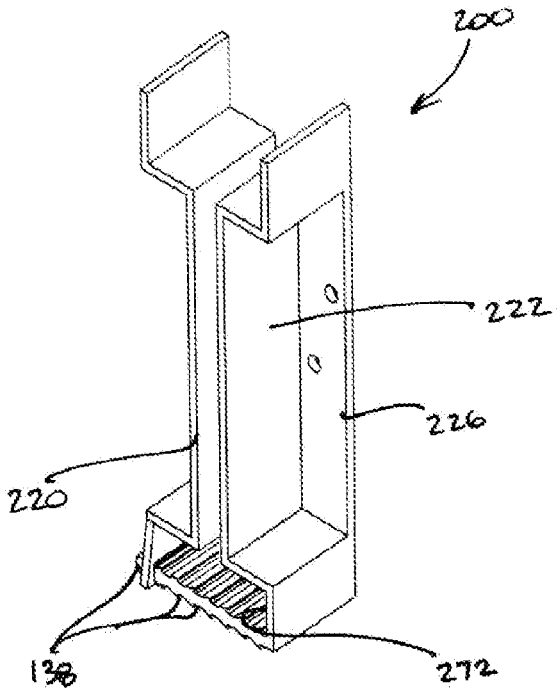
FIG. 16 is a perspective view of the hanger of FIG. 14 with first and second member attached.
Figure 17:
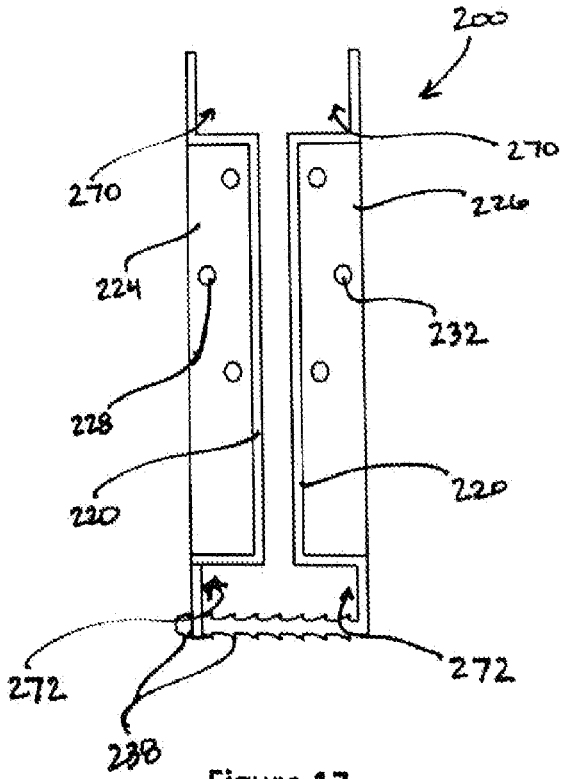
FIG. 17 is a front elevation view of the hanger of FIG. 16.

With reference to FIG. 9, preferably, each of the fastener openings, 30 and 34, has a central axis, $A_L/A_R$ that extends at an angle, $\alpha$ and $\beta$, within an approximate range of 15-60° relative to the respective flat side member, 20 and 22, through which it extends. More preferably, each of the axes, $A_L$ and $A_R$, extends within an approximate range of 25-45° relative to the respective flat side. In a particularly preferred embodiment, each of the axes, $A_L$ and $A_R$, extends at approximately 35° relative to the respective flat side.

Figure 4:
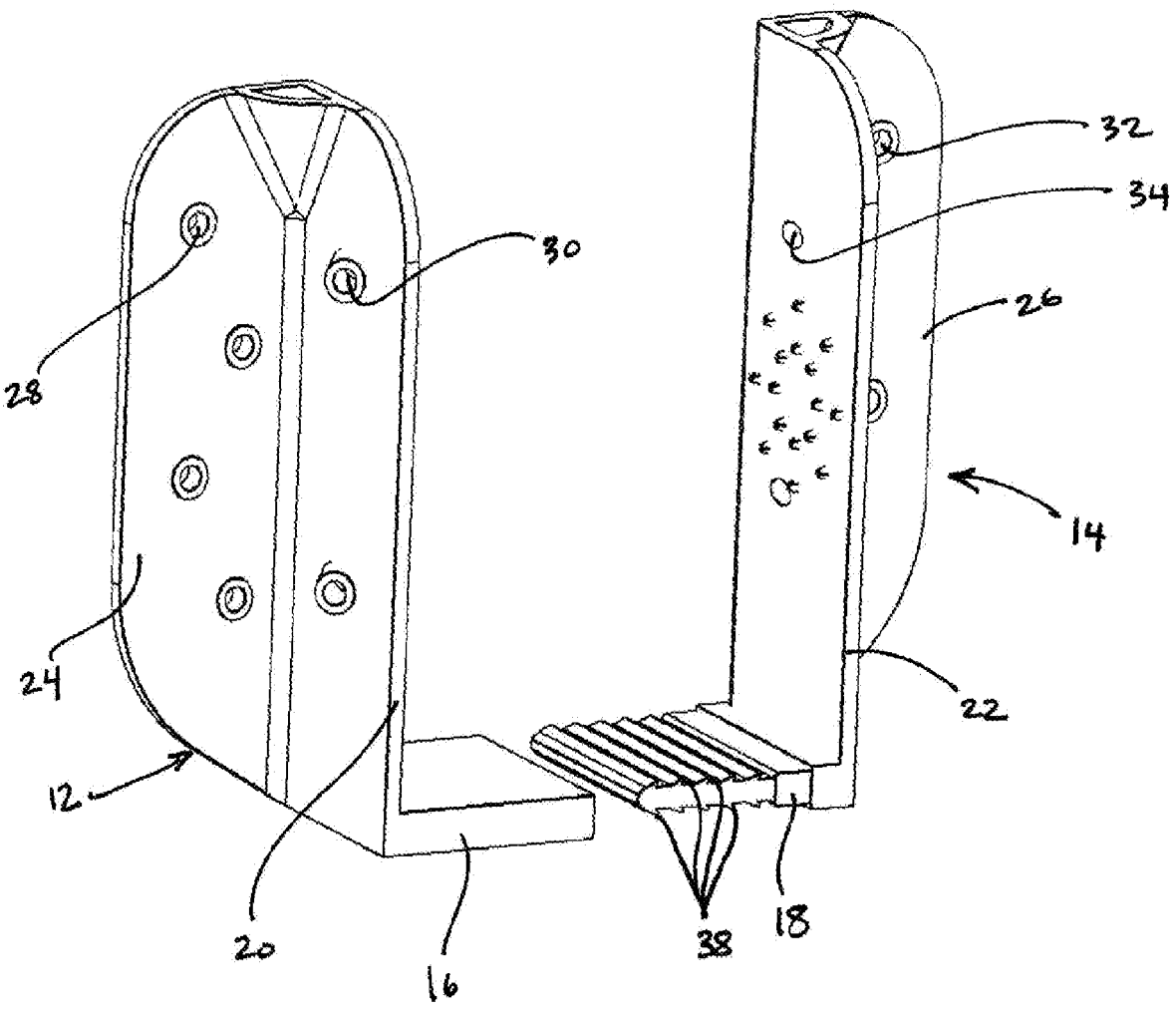
FIGS. 4 and 5 show the disclosed joist hanger separated into its two distinct parts.
Figure 5:
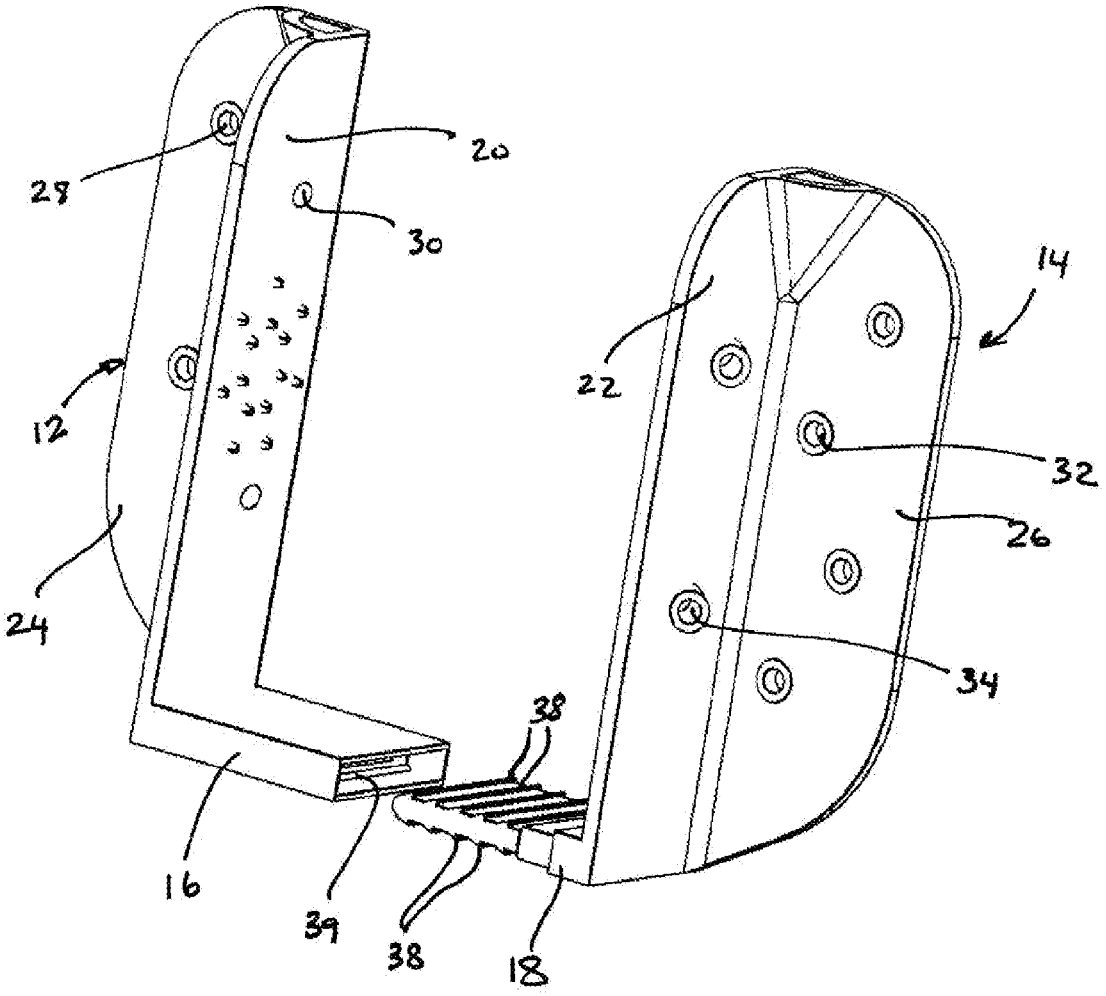
Figure 6:
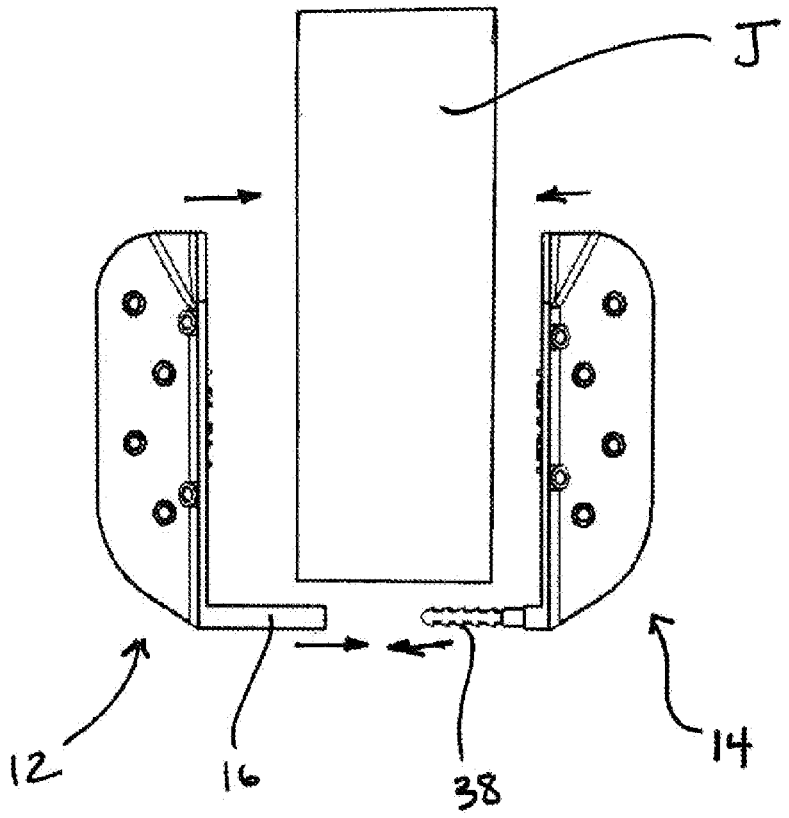
FIG. 6 is a graphical representation of a clamping attachment of the joist hanger to a joist.
Figure 8:
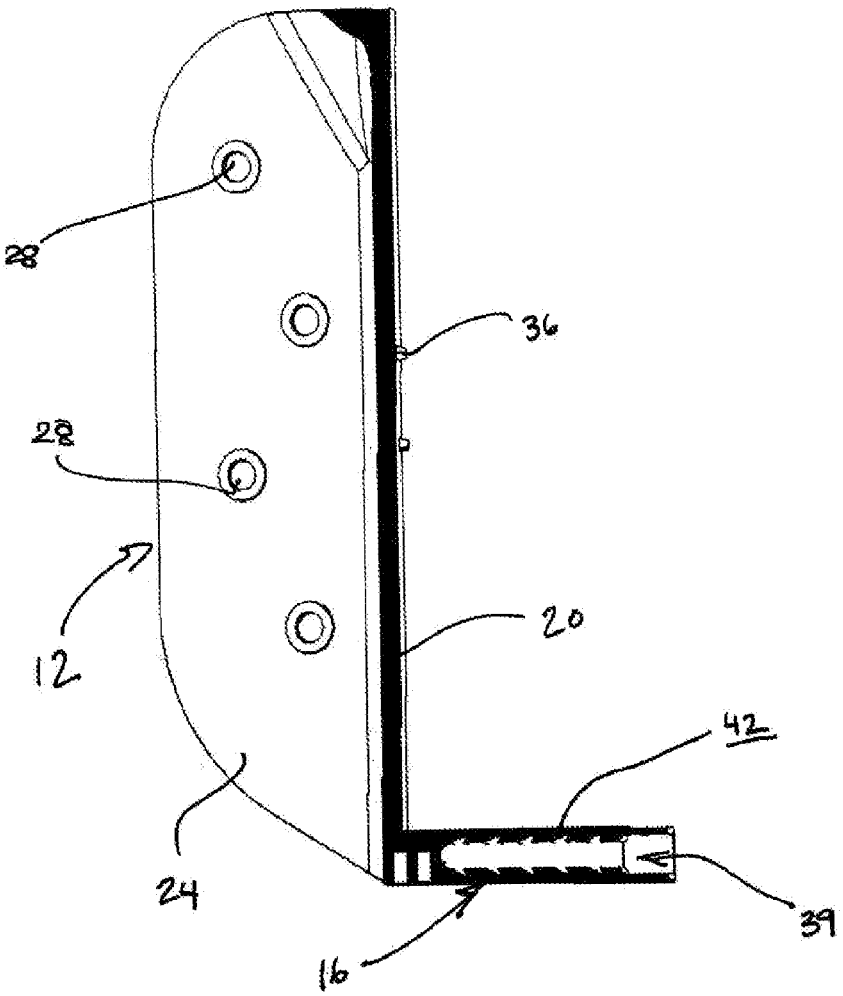
FIG. 8 is a cross-sectional view of a half portion of the joist hanger of FIG. 2.

With reference to FIGS. 4-6, the first (left) member 12 and second (right) member 14 that form the hanger 10 are actually two separate members that attach to each other to form the hanger. As shown, the right member 14 includes an inner web member 18 with a series of teeth 38 in its outer surface. The left member 12 includes an outer web member 16 with a flat outer surface 42 and defining an inner ratchet channel 39 with a series of notches or reversed acute teeth configured to lockingly receive the teeth 38 of the inner web member 18 to lock the left and right members laterally. As shown in the cross-sectional view of the left member in FIG. 8, the notches in the ratchet channel 39 have an acute configuration which creates a permanent or near permanent attachment with the teeth 38 with similar acute outer surfaces, i.e., the configuration and shape of the teeth and channels prevents reverse pullout of the inner member 18 from the outer member 16 once engaged. Other embodiments exist that incorporate a release lever to actuate a locking tooth in one or both of the outer web member 16 or inner web member 18 to optionally release the ratchet engagement.

Unlike any known joist hangers, the disclosed hanger 10 is configured to be pre-attached to a joist prior to attaching the joist and hanger to a ledger. FIG. 6 shows a representation of an attachment of the hanger 10 to a joist J. The left member 12 and right member 14 are pushed together with teeth 38 of the inner web member 18 received within the inner ratchet channel 39 to clamp the joist J between the left and right sides, 20 and 22, with the lower edge of the joist J against the flat outer surface 42 of the outer web member 16. When the left member 12 and right member 14 are clamped together tightly, the prongs 30 may penetrate the surfaces of the joist to assist in effecting a tight attachment. While not present in the depicted embodiments, the side panels, 20 and 22, may include additional holes for driving fasteners straight (left and right in the view of FIG. 6) into the joist after making an initial tight ratchet attachment.

Figure 7:
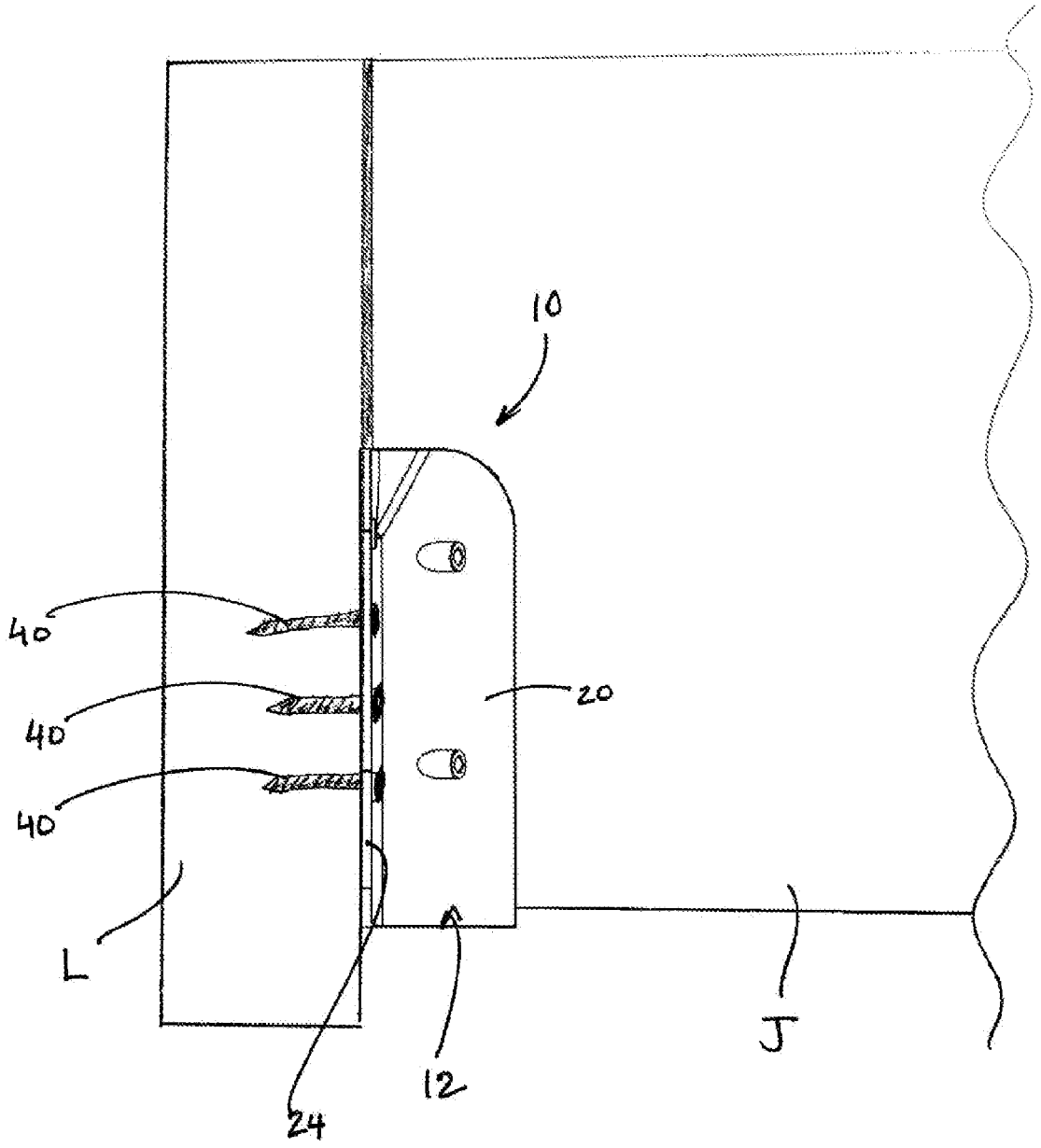
FIG. 7 is a side view of a building connection using the disclosed joist hanger.

After clamping attachment of the hanger 10 to the joist J, the joist J can be positioned as desired and attached to a ledger L via fasteners 40 driven straight through the rear flanges, 24 and 26 (see FIG. 7). Finally, fasteners 40 are driven through the oblique openings, 30 and 34, through a rear portion of the joist J and into the ledger L to form a toenail connection. Notably, the vertical positioning of the right side oblique openings 34 is offset from the vertical positioning of the left side oblique openings 30 to prevent the obliquely driven fasteners from colliding or obstructing one another. The process of attaching the hanger 10 to the joist J first, instead of to the ledger L, as is common in the art, helps installers level the joists relative to one another as there is often a natural variability in the actual dimensions of lumber used for joists.

The preferred embodiment of the joist hanger is made from a molded polymeric or composite material, which allows optional pre-setting of the fasteners 40. The fasteners are typically steel, which may be treated in any known manner to improve strength, hardness and corrosion resistive properties (i.e., heat treating, coating, etc.). The hardware is not limited in terms of dimension. Other elements can be incorporated into the hanger 10 to improve strength, such as for example, ribs in the outer surface and/or raised dimple portions around the fastener openings.

Figure 2:
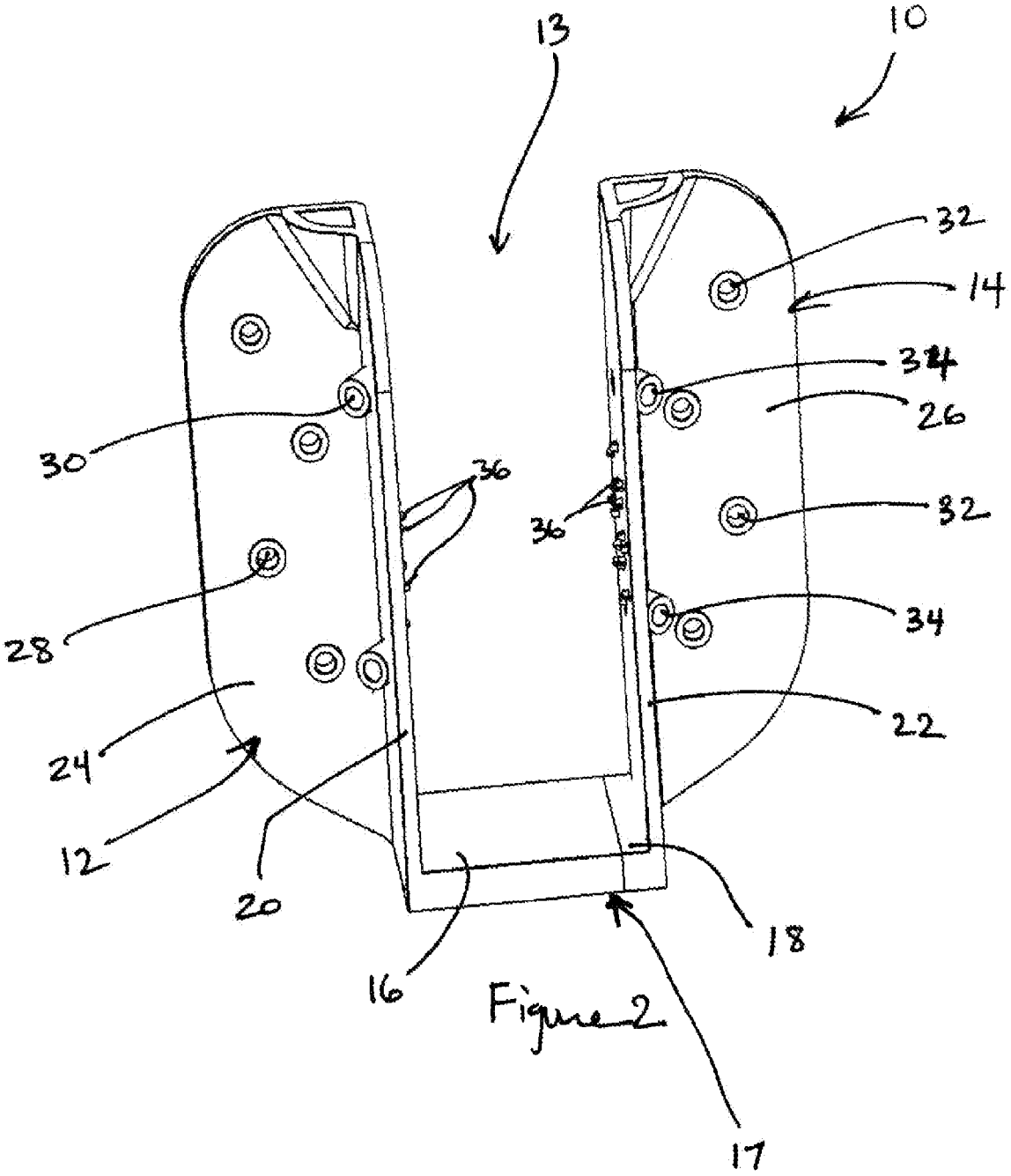
FIG. 2 is a front perspective view of the joist hanger of FIG. 1 with fasteners removed.
Figure 3:
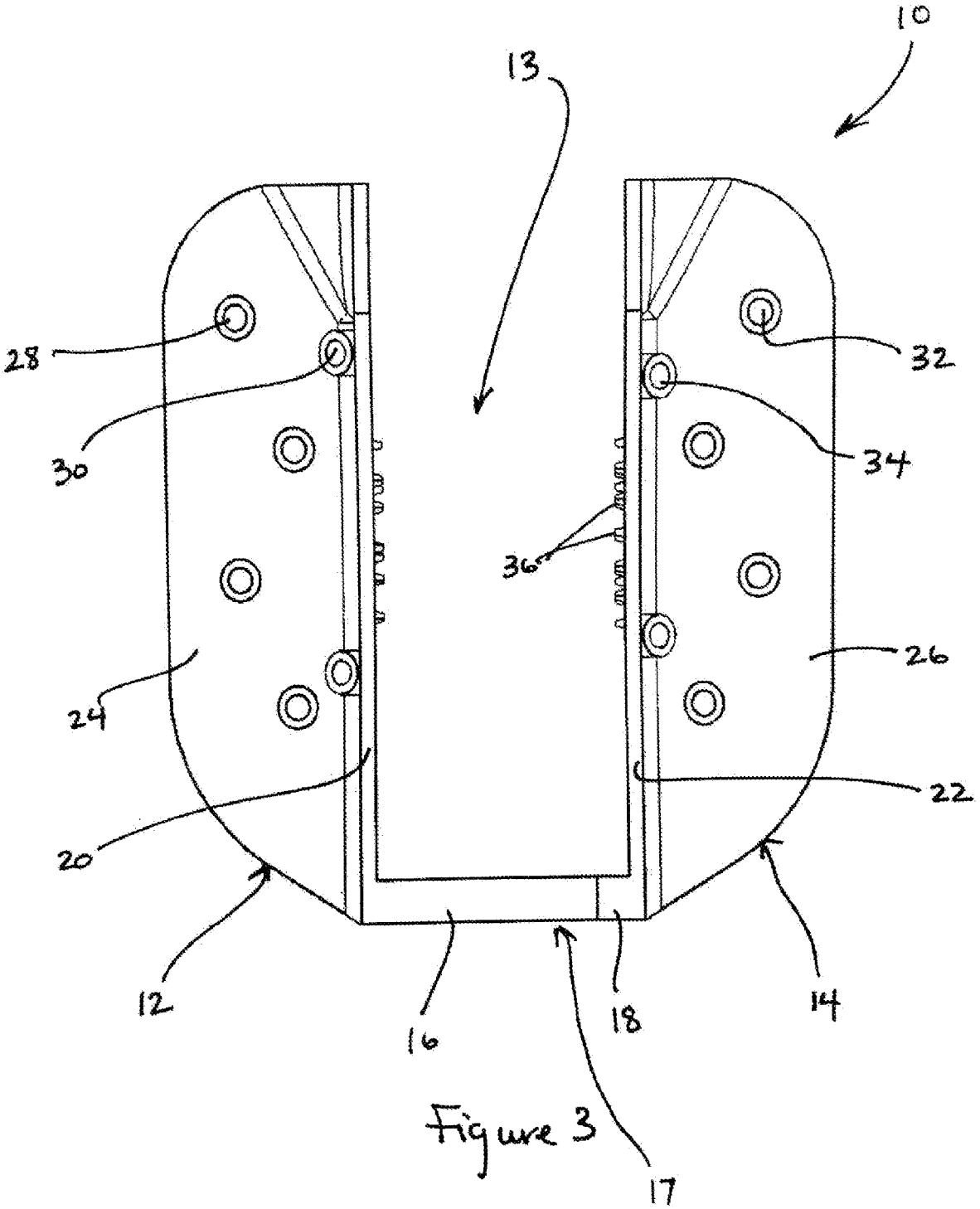
FIG. 3 is a front elevation view of FIG. 2.

FIGS. 10-13 show another embodiment of a hanger 100. This embodiment is substantially similar to the hanger 10 of FIGS. 1-9, including a first (left) member 112 with a left panel 120 and left rear flange 124 and a second (right) member 114 with a right panel 122 and right rear flange 126. Likewise, each of the rear flanges includes a plurality of rear fasteners openings, 128 and 132. The side panels additionally preferably include side fastener openings like those shown as reference numerals 30 and 34 in FIGS. 2 and 3, which are configured to allow driving of fasteners obliquely through the panels and into the elongate building member (joist) and building support (ledger) to establish a toenail connection.

In this embodiment of the hanger 100, rather than including two cooperative web members like the earlier embodiment, one member 114 includes a web member 116 with a series of spaced teeth 138 in at least a distal portion. The other member 112 includes a slot 118 extending laterally through a portion of the member with at least one locking tooth 139 configured to cooperate with the teeth 138 in the web member 116 to lock the left and right members, 112 and 114, together. The teeth 138 in slot 118 locking configuration is comparable in operation and function to a cable tie (also referred to as a zip tie).

The hanger 100 operates much like the earlier embodiment. The left member 112 and right member 114 are attached to one another via extending the web member 116 with the teeth 138 through the slot 118 to lock with the tooth 139, thereby forming a cavity between the right panel 122, left panel 120 and web member 116 for an elongate beam (joist). The right and left members are moved together with the teeth of the web member 116 pulled through the slot 118 until the beam is trapped tightly between the respective panels in a clamped configuration. Beams of differing thicknesses can be attached in this manner simply by pulling the web through the slot until the beam is clamped between the side panels. Any excess portion of the web 16 extending through the slot 18 can optionally be cut and removed. After attaching the hanger 100 to the beam, they can be attached to a rear support via fasteners driven through the rear fastener openings/guides, 128 and 132, and then the side fastener openings/guides, 130 and 134, which extend obliquely through the side panels, 120 and 122. Like the earlier embodiments, each of the left and right side openings are vertically offset from each other to allow fasteners to cross when driven through them into the beam and support member.

Additionally, while the depicted embodiment includes a set of teeth 138 in both the upper and lower surfaces of the web member 116, other embodiments exist with teeth in only one surface (upper or lower). Likewise, the slot 118 with tooth 139 can be configured to cooperate with the particular web member (i.e., tooth in bottom or top of slot or teeth in both top and bottom).

Another embodiment of a hanger 200 is depicted generally in FIGS. 14-17. As shown, this embodiment includes a left member 212 and right member 214 with surfaces and panels specifically designed to combine to form an I-shaped cavity to accommodate an end of an I-beam. As can be seen, the hanger 200 is formed from a first member 212 and second member 214 with similar general characteristics as the earlier embodiments, including side panels, 220 and 222, in each configured to clampingly trap an end of a beam when the first and second members are attached to one another. As shown, the first and second members, 212 and 214, include contours that define upper and lower slots, 270 and 272, respectively, to accommodate the flanges of an I-beam. As can be seen, in the depicted exemplary embodiment, the second member 214 includes a laterally extending section with spaced teeth 238 configured to be received within a slot 218 and cooperate with at least one locking tooth 239 in the first member 212 in a ratchet locking engagement.

Each of the first and second members includes a rear flange, 224 and 226, with fastener openings, 228 and 232, for assisting in attaching the I-beam and hanger to a support structure, much like the joist J and ledger L shown in FIG. 7.

Alternate embodiments of the I-beam hanger 200 exist with a ratchet mechanism like that of the hanger 10 in FIGS. 1-7. In such embodiments, a ratchet channel is defined within a laterally extending web section in the first member 212, in place of the slot 218 shown in FIGS. 14-17.

Like the hanger 10, the hangers, 100 and 200, are preferably made from a molded polymeric or composite material and may optionally include pre-set fasteners in any of the fastener openings.

The disclosed embodiments of the clamping hanger, 10, 100 and 200, provide substantial variability by being usable to clamp beams having virtually any thickness or double beams. The ratchet locking mechanism provides a robust rigid clamping attachment to the beam. Additionally, the embodiments allow optional presetting of fasteners to improve efficiency and accuracy of installation.

While preferred embodiments of the foregoing have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A clamping hanger for attaching an elongate building member to a building support member, comprising:

a first member defining a first side and a first lateral web section having at least one first locking tooth, and a second member defining a second side and a channel with a second locking tooth cooperative with the at least one first locking tooth, wherein the first member and second member are lockingly attachable to one another via cooperation of the at least one first locking tooth and the second locking tooth, the clamping hanger is configured to trap an elongate building member between the first side and second side in a clamped arrangement with the first web section in abutment with an edge of the elongate building member, and the first member and second member each has a respective rear flange substantially perpendicular to the first side and second side, respectively, and wherein the first side, second side and rear flanges each defines one or more holes configured for receipt of a fastener driven therethrough.

2. A clamping hanger for attaching an elongate building member to a building support member, comprising:

a first member defining a first side and a first lateral web section having at least one first locking tooth, and a second member defining a second side and a channel with a second locking tooth cooperative with the at least one first locking tooth, wherein the first member and second member are lockingly attachable to one another via cooperation of the at least one first locking tooth and the second locking tooth, the clamping hanger is configured to trap an elongate building member between the first side and second side in a clamped arrangement with the first web section in abutment with an edge of the elongate building member, and the first side member and second side member each defines one or more fastener holes that extends obliquely through the respective side member.

3. The clamping hanger of claim 2, wherein the second member includes a second lateral web section that defines the channel and includes the second locking tooth.

4. The clamping hanger of claim 2, wherein the first and second members attach to one another via a cooperative ratchet configuration.

5. The clamping hanger of claim 3, wherein the first lateral web section and second lateral web section are substantially parallel and combine to form a support web for the elongate building member when the first member and second member are attached.

6. The clamping hanger of claim 5, wherein the first lateral web section defines an inner section configured for receipt and containment within the inner channel.

7. The clamping hanger of claim 4, wherein the ratchet engagement is permanent and not configured for release.

8. The clamping hanger of claim 2, wherein the holes in the sides are formed by tubular projections having a portion that extends from a surface of the respective side.

9. The clamping hanger of claim 2, comprising elongate fasteners preset in one or more holes in the rear flanges or side members or both.

10. The clamping hanger of claim 2, wherein the first member and second member are formed of a molded polymer or composite material.

11. The clamping hanger of claim 2, wherein the first member and second member have respective contours configured for the hanger to clamp to an I-beam when the first and second members are attached with a portion of a flange of the I-beam maintained in a channel defined in the first member and another portion of a flange of the I-beam maintained in a channel defined in the second member.

12. The clamping hanger of claim 2, wherein the first and second members are lockable to one another at multiple different lateral positions relative to one another.

13. The clamping hanger of claim 2, wherein the channel is formed as a slot through opposing lateral surfaces of the second member and a portion of the first lateral web section extends through the slot when the first member and second member are lockingly attached.

14. A clamping hanger for attaching an elongate building member to a building support member, comprising:

a first member having a flat first side member and a laterally extending first web member;

a second member having a flat second side member and a laterally extending second web member, wherein the first web member and second web member include cooperative ratchet teeth to lock to one another and thereby attach the first member to the second member, the clamping hanger is configured to trap an elongate building member between the first side member and second side member in a clamped arrangement when the elongate building member is placed between the first member and the second member, and each of the flat first side member and flat second side member includes at least one fastener guide hole extending obliquely therethrough.

15. The clamping hanger of claim 14, wherein the first web member defines a ratchet channel with notches and the second web member defines an inner ratchet section with teeth in an outer surface, and wherein the inner ratchet section is received within the ratchet channel to lock the first member to the second member.

16. The clamping hanger of claim 14, wherein cooperative ratchet teeth are configured to lock with one another permanently and not be releasable.

17. A method of attaching an elongate building member to a building support, comprising providing an elongate building member;

providing a two-part hanger comprising a first member with a first side panel having a first fastener guide hole extending obliquely therethrough, the first member including a first locking member, and a second member with a second side panel having a second fastener guide hole extending obliquely therethrough, the second member including a second locking member cooperative with the first locking member;

attaching the first member to the second member with an end of the elongate building member positioned laterally between the first side panel and second side panel via connection of the first locking member to the second locking member in a laterally restrained connection with the elongate building member clamped between the first side panel and second side panel; and attaching the hanger and elongate beam to the building support via driving a fastener through each of the first fastener guide hole and second fastener guide hole, through a portion of the elongate beam and into the building support.

18. The clamping hanger of claim 1, wherein the second member includes a second lateral web section that defines the channel and includes the second locking tooth.

19. The clamping hanger of claim 1, wherein the first member and second member are formed of a molded polymer or composite material.

20. The clamping hanger of claim 1, wherein the first and second members are lockable to one another at multiple different lateral positions relative to one another.

21. A clamping hanger for attaching an elongate building member to a building support member, comprising:

a first member having a first side member with a first inner surface and a laterally extending first web member, at least a portion of the first inner surface being flat;

a second member having a second side member with a second inner surface and a laterally extending second web member, at least a portion of the second inner surface being flat, wherein the first member and second member are lockable to each other in a laterally restrained connection, the clamping hanger is configured to trap an elongate building member between the first inner surface and second inner surface in a clamped arrangement with the first side member and the second side member on opposite lateral sides of the elongate building member, and each of the first side member and second side member includes at least one fastener guide hole extending obliquely therethrough.

22. The clamping hanger of claim 20, wherein the first member and second member are lockable to each other in a laterally restrained connection via a ratchet mechanism.

23. The method of claim 17, wherein connection of the first locking member to the second locking member is via a ratchet mechanism.

* * * * *